US005774904A

United States Patent [19]

McWilliams

[11] Patent Number: 5,774,904

[45] Date of Patent: Jul. 7, 1998

[54] AUTOMATIC TOILET SEAT COVER CLOSING DEVICE

[76] Inventor: Dennis M. McWilliams, 7 Ronda, Florissant, Mo. 63031

[21] Appl. No.: 795,020

[22] Filed: Feb. 5, 1997

[51] Int. Cl.[6] ..... A47K 13/10

[52] U.S. Cl. ..... 4/246.2

[58] Field of Search ..... 4/246.1–246.5

[56] References Cited

U.S. PATENT DOCUMENTS

| | | | |
|---|---|---|---|
| 0,454,743 | 6/1891 | Kremelberg | 4/246.1 |
| 1,291,125 | 1/1919 | Pope | 4/246.2 |
| 1,821,027 | 9/1931 | Oya . | |
| 2,214,323 | 9/1940 | Carter . | |
| 2,636,185 | 4/1953 | Boston | 4/246.1 |
| 2,849,728 | 9/1958 | Gyllenberg . | |
| 3,781,924 | 1/1974 | Davis, Jr. . | |
| 4,291,422 | 9/1981 | Shoemaker et al. . | |
| 4,887,322 | 12/1989 | Lydon . | |
| 5,058,216 | 10/1991 | Trayer et al. . | |
| 5,060,318 | 10/1991 | Jaskiewicz . | |
| 5,222,260 | 6/1993 | Piper . | |
| 5,369,814 | 12/1994 | Denys . | |
| 5,400,442 | 3/1995 | Pendlebury . | |
| 5,430,897 | 7/1995 | Lavender . | |

*Primary Examiner*—Charles E. Phillips
*Attorney, Agent, or Firm*—Kalish & Gilster

[57] ABSTRACT

A device for automatically closing a toilet bowl cover upon flushing of the toilet has an elongated housing with a water outlet port formed therethrough and a water inlet port connectable to a source of water. The forward end has a central aperture for passage of a piston rod, and also supports the device in a substantially horizontal position within the toilet tank, above the level of the water. The rearwardly directed end is connected to a water inlet source when in normal use position, and the other end is supported from the front of the tank in a substantially horizontal position. A piston is disposed longitudinally within the housing, the piston rod terminating rearwardly in a piston head and extending forwardly through the aperture in the forward end of the housing, adjacent to and above the upper edge of the toilet tank, beyond the tank wall to contact the upright cover of the toilet bowl. The piston rod moves linearly forwardly within the housing when water enters the inlet port, pushing against the piston head and causing the piston rod end to push the cover forwardly until gravity causes the cover (and the seat if it is raised) to fall closed.

15 Claims, 3 Drawing Sheets

AUTOMATIC TOILET SEAT COVER CLOSING DEVICE

BACKGROUND AND SUMMARY OF THE INVENTION

The present invention relates generally to the field of toilet closing devices, and, more particularly, to a device for automatically causing the cover of a toilet seat and bowl to automatically close when the toilet is flushed. If the toilet seat is in the raised position it will also automatically return to the lowered position as the toilet bowl cover is caused to drop.

The present invention is composed of a modified cylinder and piston rod arrangement which is attached inside the top of the toilet tank, under the tank lid. The water line for filling the tank is re-routed to an inlet in the modified cylindrical housing. Accordingly, upon application of water pressure, as prompted by the flushing of the toilet, water enters the cylinder and actuates the piston and rod linearly. The rod extends past the tank wall to force the top of the toilet lid and seat forwardly outward until the lid and seat fall on the toilet bowl. After the piston and rod extend a predetermined length, the piston passes a water outlet in the cylinder wall, whereupon the water exits the cylinder (housing) and fills the tank. The piston rod is spring-biased, causing the piston rod to return to the pre-flush, original position after the water ceases to flow.

It is to be understood that the present device can also function for the intended purpose under pneumatic pressure instead of the hydraulic pressure which would most commonly be available with water flush toilets. Thus, although the usual reference herein is to water for operation of the new device, for convenience and simplicity of the text, appropriate adaptations will be evident to those skilled in the art if it is desired to use the invention with a vacuum operated toilet.

It is well established that toilets (sometimes referred to herein as commodes) of types commonly found in most modern households present a safety hazard to very young children. Such children, for example those of an age generally referred to as toddlers, tend to be attracted by the swirling water in the toilet bowl and to consider the toilet to be a play-thing. Unfortunately, such young children also tend to be "top-heavy" and sometimes drown when the excessive weight of their heads causes them to fall forward into the toilet bowl as they are playing.

Also, many individuals wish to keep toilets closed when not in immediate use, for aesthetic reasons, and so as to prevent objects stored on the back or tank top of the toilet from falling into the bowl.

For the above reasons and others, there has been a long-standing controversy among members of many households regarding the importance of putting down a toilet seat and/or replacing the cover over a toilet bowl to the closed position after use of the toilet. Certain members of some households (or other establishments where a number of individuals use the same toilet facilities) have difficulty in remembering, or simply neglect, to return the toilet seat and/or cover to a lowered (closed) position, and other members find the open or seat-up disposition of the toilet to present a hazard or cause of certain inadvertancies Thus, there has been a long-felt need for a convenient method by which to automatically cause a toilet seat or cover (or both), which have been left in an open or upright position to return to a substantially horizontal, "down", or closed position. A variety of devices are known for use in causing the seat cover to close after a toilet is used, so that the user is relieved of the need to remember to so close the cover or put the seat down after use in a standing position.

Some previous toilet closing devices are more complex and thus expensive to purchase, as well as being more difficult to install and maintain, as compared to the device described herein. Other such known devices are attached for use on the exterior of the toilet, either outside the tank, or outside the bowl and thus may be less desirable as they impair the general appearance of the toilet, and/or can become difficult to maintain as they are constantly exposed and readily collect dust and grime.

Still other known devices are difficult and expensive to install and maintain be cause they must be located in the bottom of the water tank of the toilet, submerged in the water, and/or they operate by an indirect transfer of forces, causing such devices to be more complicated and less efficient in their operation, as well as more prone to mechanical problems.

By contrast, the new toilet closing device is a valve containing a linearly actuated piston, which valve is disposed inside the top of the toilet tank, just under the lid where it is readily accessible and facile to install and maintain or replace if necessary.

The new device costs nothing extra to use, after the initial purchase price, because the operation of the device is automatically triggered by the hydraulic forces which operate inside the toilet tank when the toilet is flushed. The simple linear action of the new device helps to ensure reliable operation thereof over a long period of repeated use.

Thus, it is among the several objects of the present invention to provide a device for causing automatic closing of either the toilet cover alone, or the seat and cover together, as the case may be, when the toilet to which they are attached is flushed. It is desired that subject device be enclosed, substantially entirely within the toilet water tank and be powered entirely by the water in such tank during the normal flushing operation. Thus, the user need only flush the toilet after use, in the usual fashion, to cause the commode to be returned to the seat down, closed cover position, by normal action of the tank water pressure on the presently claimed valve device.

It is further among the objects of the present invention, having the features indicated, that the device be simple to install in most known types of toilet tanks, and that such installation require effectively no training, so that an individual with no formal technical training in plumbing skills can readily install the device in a pre-installed toilet, or as a pre-installed part of a new bathroom commode.

It is foreseen that the device will sometimes be provided as part of a kit suitable for home installation by the "do-it-yourselfer", or by a professional plumber, the kit including the valve device described and claimed hereafter, and one or more hoses or other connecting tubes and water lines for installation, as well as the optional inclusion of readily attachable bumper cushions or pads of a type to prevent a loud banging and potential damage to the toilet bowl rim when the toilet lid or seat and lid fall from a substantially vertical, open position to a substantially horizontal, closed position, upon activation of subject closing device.

Accordingly, in furtherance of the above objects the present invention is, briefly, a device for automatically closing a toilet bowl cover upon flushing of the toilet. The new device has an elongated housing with a water outlet port formed therethrough and a water inlet port connectable to a source of water. The forward end has a central aperture for passage of a rigid piston rod, and also supports the device in a substantially horizontal position within the toilet tank, above the level of the water. The rearwardly directed end is connected to a water inlet source when in normal use position, and the other end is supported from the front of the tank in a substantially horizontal position. A piston is disposed longitudinally within the housing, the piston rod terminating rearwardly in a piston head and extending forwardly through the aperture in the forward end of the housing, adjacent to and above the upper edge of the toilet tank, beyond the tank wall to contact the upright cover of the toilet bowl. The piston rod moves linearly forwardly within the housing when water enters the inlet port, pushing against the piston head and causing the piston rod end to push the cover forwardly until gravity causes the cover (and the seat if it is raised) to fall closed.

These and other advantages of the invention will be in part apparent and in part pointed out hereinbelow.

BRIEF DESCRIPTION OF THE DRAWINGS

Throughout the drawings like parts will be indicated by like element numbers.

DESCRIPTION OF THE PREFERRED EMBODIMENT

With reference to the drawings, 10 generally designates a valve device constructed in accordance with and embodying the present invention. Device 10 is a linearly actuated valve which, as will be described in greater detail hereafter, is made operational by the force of water which is redirected through device 10 as the water is introduced into the toilet tank to refill the tank after flushing of the toilet, which flushing has been triggered in the normal manner, by activation of a handle, button, lever, or other known or equivalent toilet flushing activation means.

Figure 7:
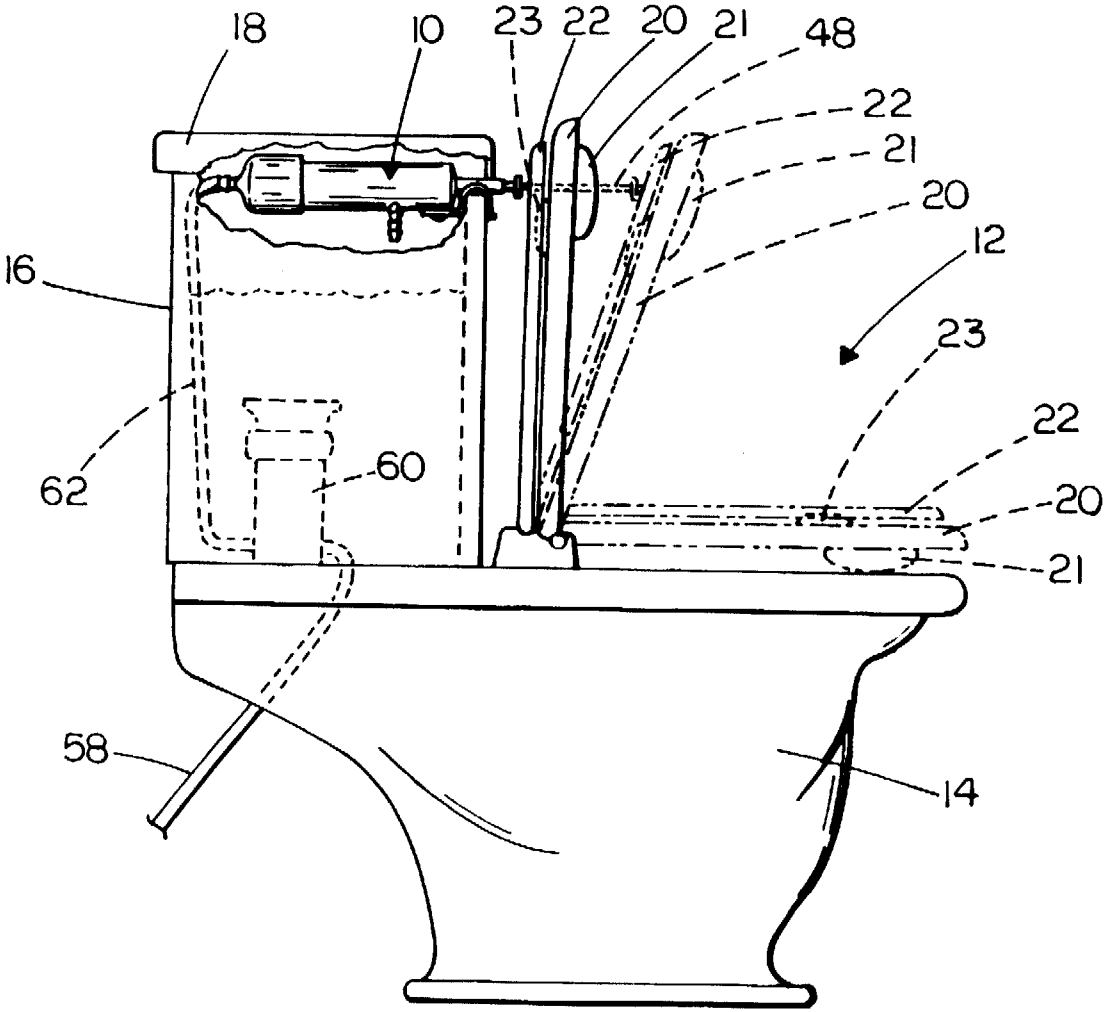
FIG. 7 is a side elevational view of the device of FIG. 1, reduced, and shown in an example of a useful position within a toilet tank, shown schematically and partially broken away.
Figure 5:
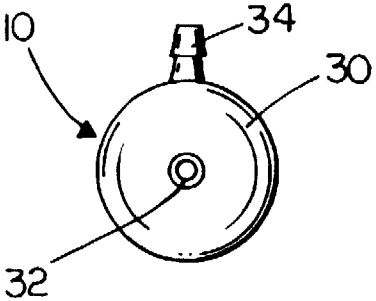
FIG. 5 is an end elevational view of the device of FIG. 1, taken from the end shown at the left of FIG. 4.
Figure 6:
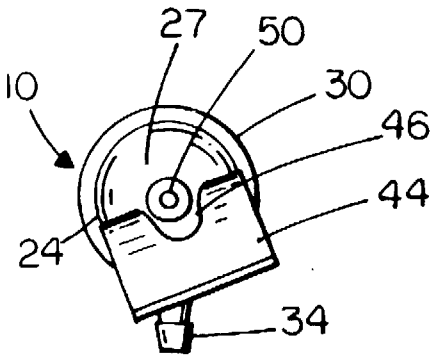
FIG. 6 is and end elevational view of the device of FIG. 1, taken from the opposite end as that shown in FIG. 5, and rotated end to end, 180°.

Device 10 is intended for installation in any type of conventional toilet, such as that shown schematically in FIG. 7, and indicated generally as 12, having a bowl 14 and a water tank 16. Water tank 16 is topped by a lid 18 which is shaped and sized, in the usual manner to rest atop the upper edge of tank 16. Toilet 12 also has a seat 20 and cover 22 which are both pivotally connected at the rearward portions thereof, substantially adjacent to the intersection of the upper edge of bowl 14 and the lowermost end of the front-facing wall of tank 16, so that the seat and cover can be disposed substantially horizontally over the rim of the bowl, in the conventional manner when it is desired for the cover to be in the closed position, or for the seat to be in the lowered position for seated use of toilet 12.

Optional cushions or pads, such as those indicated by way of example (in phantom) at 21 and 23 in FIG. 7 are provided as part of a kit containing device 10, or may be obtained independently from device 10 for either professional or amateur installation. Self-stick pads 21, 23 are formed of any useful material and size, and are placed by the user or installer of device 10 in at least one and preferably two positions beneath the lower surface of both the seat 20 and the cover 22, respectively, so as to reduce noise and shock when the toilet seat and cover are caused by activation of device 10 to return to substantially horizontal, closed positions. Of course pads 21, 23 may also be of any appropriate variety other than the self-sticking type, and may be attached by any known, conceivable method to the corresponding undersurface of cover or lid 22 and seat 20, as long as the size, material and placement of the pads provide the desired cushioning, noise-dampening effect.

Some portions of the conventional inner workings of toilet tank 16 are indicated in phantom in FIG. 7 and will be mentioned further hereafter in a discussion of the function of device 10, other conventional portions of the inner workings of the toilet tank are omitted for clarity and simplicity of the drawings. It is to be understood, however, that device 10 is suitable for use with any conventional style of toilet having a water tank disposed rearwardly of a pivotally connected toilet bowl lid and/or seat.

FIGS. 1–6 illustrate the structure of device 10 in detail, and FIG. 7 shows an example of device 10 in situ. Device 10 has a preferably cylindrical, elongated housing 24 formed desirably of plastic, but which housing may conceivably be formed of other materials such as metal, or even glass or ceramic. Housing 24 has a continuous side wall which extends between a rearwardly directed end 26 and a forwardly directed end 28 of the housing. In the most preferred embodiment, for optimal operation with most conventional residential toilets and water supplies, housing 24 is approximately four inches long and has an internal diameter of about ⅝ inch. However, the size can of course be varied as may be necessary to improve operation of device 10, depending upon water pressure and all other ambient conditions of the installation site.

An end cap 30 is preferably formed of a style which is force fit over rearwardly directed end 26 of device 10 in such a tight-fitting manner as to be essentially water-tight. Optionally, end cap 30 can be sealed to end 26 by adhesive or heat-sealing, or by other known attachment means, such as by screw threads, or even by being formed integrally, as by being molded as one piece. In any case, an attachment site, such as, for example, nipple or nozzle 32 is provided on end cap 30 as an inlet port, to permit interconnection of a source of water to device 10. Other types of known connecting structures are also conceivable which will function adequately for this purpose. Although end cap 30 is illustrated as being formed of plastic, as is preferred, certainly other materials may be used successfully.

A water outlet nozzle 34 is provided forwardly on housing 24. Although this outlet site is preferred to be formed as a nozzle, it can alternatively be formed merely as an opening 36 in the housing, such as that shown in phantom in FIG. 4, as one example.

Figure 1:
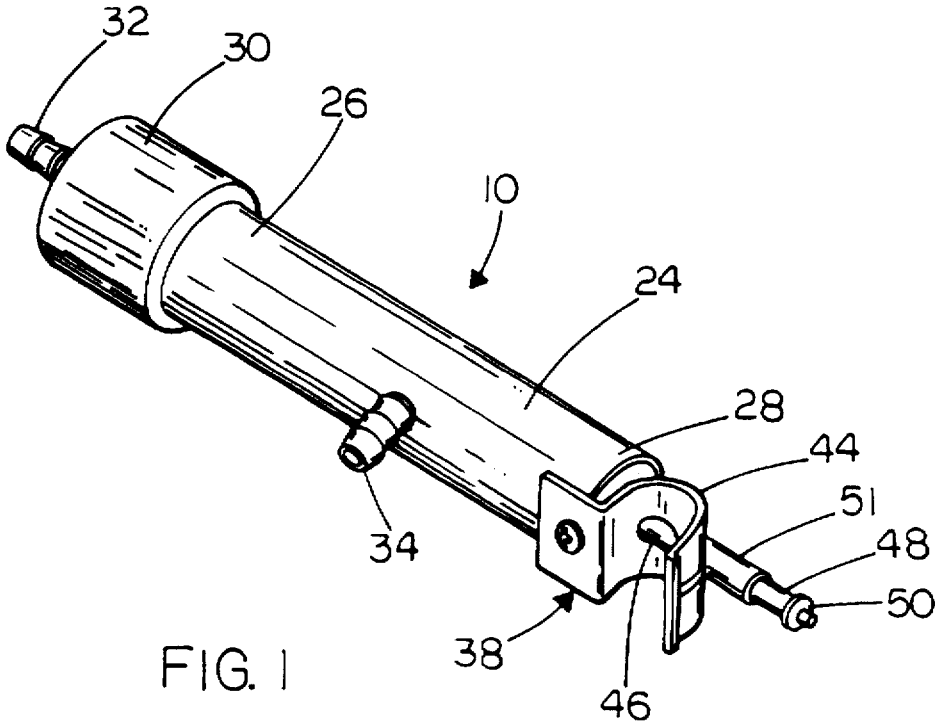
FIG. 1 is a perspective view of a device constructed in accordance with and embodying the present invention, for causing the automatic closing of a toilet seat and cover when the toilet is flushed.

Forwardly of the position of outlet nozzle 34 end 28 of housing 24 has a mounting bracket such as that shown at 38, for example, with a flange 40 extending rearwardly and attached, for example by a fastener 42 or other suitable connecting device, to housing end 28. As shown, bracket 38 has a wide hook portion 44 which curves forwardly and downwardly in normal use position, so as to be disposed over the upper forward edge of toilet tank 16, as illustrated in FIG. 7, to suspend device 10 in operative position. Other types of clamps or connectors are known or can be conceived which will suffice to support or otherwise retain device 10 in the position shown for the purpose described. For example, the hook portion can be straight-sided, instead of curved, as shown in FIG. 1. Further, the housing of device 10 can be attached by some structure other than the short flange portion illustrated, such as one or more elongated rigid supports, which supports could each have a forwardly connected bracket to connect to the toilet tank edge.

Figure 2:
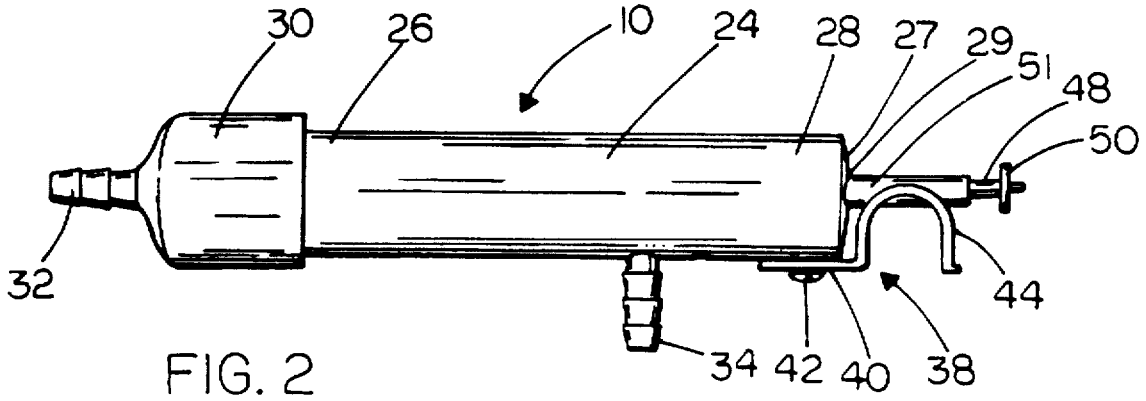
FIG. 2 is a side elevational view of the device of FIG. 1.

Hook portion 44 is shown as having a longitudinal groove or channel-like opening 46 formed therein (shown most clearly in FIG. 6), which groove provides support for a sleeve 51. Piston rod 48 is necessarily rigid and terminates forwardly in a tip portion 50, which tip may be enlarged if desired, relative to the diameter of piston rod 48, as shown in FIG. 2. Groove 46 is shown in end view in FIG. 6, slightly separated by a space beneath piston rod tip 50, for clarity. When device 10 is installed in the preferred manner for use, hook 44 is positioned over the upper edge of the front wall of toilet tank 16, and the front edge of toilet tank lid 18 rests upon sleeve 51, so that the weight of tank lid 18 assists in maintaining device 10 in a substantially horizontal position above the level of the water in tank 16.

Sleeve 51 is preferred to be loose on rod 48 and in relation to housing 24, or optionally can be fixed at the rearwardly directed end of the sleeve to an end piece or cap 27 which is molded to or fitted into the forwardly directed end 28 of elongated housing 24, as long as sleeve 51 is of sufficient inner diameter relative to the diameter of the piston rod 48 that rod 48 does not bind against the inner side wall of the sleeve. An aperture 29 is provided in end cap 27 for passage therethrough of piston rod 48 during its linear course of travel in normal use.

When installed in a conventional toilet tank 16, having a vertical front tank wall which is usually approximately one-half inch thick, piston rod 48 is preferred to be of sufficient length to have a stroke length of approximately 3 inches. However, the dimensions of device 10, including the length of piston rod 48 can be varied in size as may be necessary to allow a sufficient stroke length that tip 51 of piston rod 48 can extend forwardly on rod 48 to contact the upper surface of lid 22, which surface is rearwardly directed when the lid is in the open position.

When device 10 is so positioned, as water fills tank 16 through valve device 10 piston rod 48 will be pushed to extend linearly forwardly to a sufficient distance that lid 22, and seat 20, if raised, will be pushed forwardly by piston rod 48 far enough past a vertical plane that the force of gravity will necessitate downward motion, pivotally along the conventional hinged attachment to toilet bowl 14, until the seat and/or lid attain a substantially horizontal, downward or closed position.

Because of the usual shapes of conventional toilet tanks and toilet bowl covers (rectangular and closed oval, respectively), it is usually necessary that device 10 be installed in toilet tank 16 at the approximate center of the width of the tank, so that piston rod 48 does not bypass the cover 22 as the rod travels forwardly, but rather contacts cover 22 at or adjacent to the edge of lid 22, as shown in FIG. 7, when the lid is disposed in the open, upright position illustrated.

However, if the toilet seat is of the type which is generally oval, but has an open space at the forward central position, it is clear that device 10 cannot be positioned at the exact center of the width of the front of the toilet tank. Rather, device 10 will be installed slightly off to one side or the other from the center and, if necessary can be provided with a support bracket which permits the entire device to be suspended sufficiently lower in the tank that the forwardly stroking piston rod will be in longitudinal alignment with the upward end of the open toilet seat, as long as the device is suspended above the level of the tank water.

Figure 3:
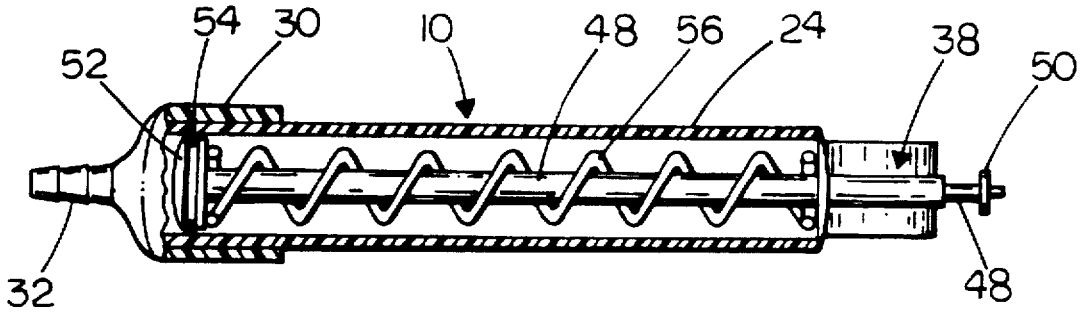
FIG. 3 is a top plan view of the device of FIG. 1, partially broken away along the length thereof.
Figure 4:
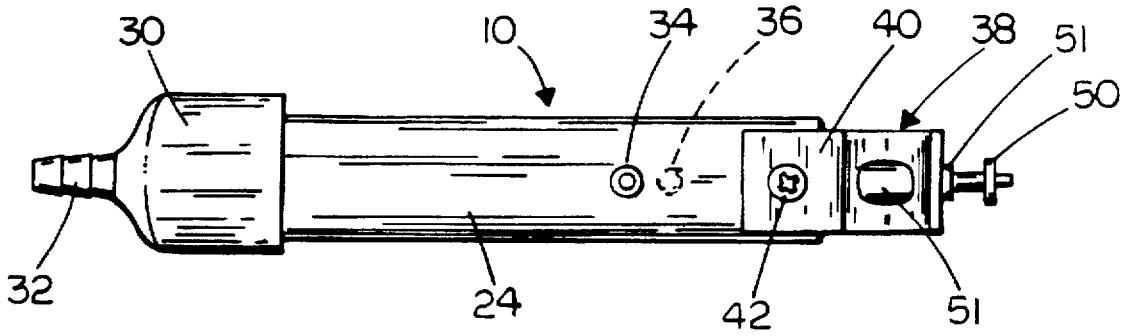
FIG. 4 is a bottom plan view of the device of FIG. 1.

FIG. 3 illustrates that internally of housing 24 piston rod 48 extends longitudinally rearwardly and terminates at its rearwardly directed end in a piston head 52 which is slidingly sealed against the internal annular wall of housing 24 by an O-ring 54 so as to provide a water-tight environment forwardly of head 52 and thereby prevent water from leaking out of device 10 to the outside of the front wall of tank 16.

Preferably a coil spring 56 is mounted on piston rod 48 forwardly of head 52 to bias the piston rearwardly for automatic return after activation of device 10 and closing of the toilet seat 20 and/or cover 22. However, it should be understood that device 10 can operate without spring 56 or any equivalent bias mechanism because when the toilet user opens the toilet, so that cover 22 is in a substantially vertical position, cover 22 will contact piston tip 50 and cause piston rod 48 to return slidingly and longitudinally to the inactivated position. Accordingly, even if spring 56 should break or become otherwise non-operational, device 10 will still function adequately.

Further with regard to use of device 10, and with reference to FIG. 7, it is clear that the new automatic toilet closing device is useful whether the use of the toilet has lifted cover 22 only, or both seat 20 and cover 22. In either case, when the user has triggered flushing of the toilet in the usual manner by pressing a handle to lift a chain attached flap (not shown) all water in tank 16 drains out of the tank. Tank 16 immediately begins to refill by entry of water via a conventional water line, such as that indicated at 58 and through an inlet valve 60 (illustrated in phantom) seated at the bottom of the toilet tank in the normal manner, for example as shown in FIG. 7.

Then, instead of simply filling tank 16 until valve 60 is caused to shut off by a float mechanism (conventional, not shown), water exiting valve 60 is rerouted, for example by a line 62 connected to inlet port or nozzle 32 at the rearwardly directed end of device 10. Entering water applies forwardly directed linear pressure against piston head 52 and forces the piston head and attached rod 48 forwardly, causing tip 50 to push straight forwardly against the upper portion of the top, rearwardly facing surface of toilet cover 22, thus causing the cover 22, and seat 20 (if lifted previously to the fully open, upward position) to pivot forwardly from the usual hinged connections thereof to the upper rear rim of bowl 14.

As indicated by the corresponding positions shown in phantom in FIG. 7, seat 20 and/or cover 22 will be caused to move sufficiently far past the vertical plane as to necessarily fall forwardly to a toilet closed position, with both seat and cover being substantially horizontal. If used, cushions 21, 23 will dampen any excessive noise from the seat and cover falling closed.

Piston rod 48 will remain in the fully extended forward position as long as water continues to enter inlet nozzle 32. Excess water in device 10 will exit housing 24 via outlet nozzle 34, which may optionally be connected to a water outlet hose or line of any suitable, normal type (not shown), alternatively, from an outlet hole 36. Piston rod 48 will automatically retract after tank 16 has sufficiently filled from water exiting housing 24 (or otherwise, if some tank refill water is selectively rerouted around device 10, in any known, acceptable water routing manner) to cause valve 60 to cut off the inlet water supply, thereby releasing forward pressure against piston head 52.

When forward, linear pressure from inlet water against piston head 52 is sufficiently reduced, spring 56 will cause piston rod 48 to move linearly, rearwardly in housing 24 so that tip 50 is retracted and toilet cover 22 (and seat 20 if desired) can be selectively lifted to a substantially vertical position by the next user of toilet 12.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description of shown in the accompanying drawings shall be interpreted as illustrative rather than limiting.

What is claimed is:

1. A device for automatically closing a toilet bowl cover upon flushing of the toilet in which the device is installed, the device comprising:

a housing having a first end and a second end and a continuous side wall extending between the first end and the second end, the continuous side wall of the housing defining a water outlet port formed through the continuous side wall, the housing first end having a water inlet port connectable to a source of water, the housing second end having a central aperture which is sized and positioned for passage therethrough of a piston rod, and the housing second end further having structure for supporting the device in a substantially horizontal position within a water tank of the toilet in which the device is installed, the normal use position of the device in the water tank being above the level of water, with the housing first end being directed toward the rear of the tank and connected to a toilet water tank water inlet source when the device is installed in a toilet in normal use position, and with the housing second end being supported on the front of the toilet water tank by the structure for supporting the device in a substantially horizontal position, and a piston having a piston rod disposed longitudinally within the housing, the piston rod having a first end and a second end, the piston rod first end extending rearwardly in the housing, and the second end of the piston rod extending forwardly through the aperture in the second end of the housing, adjacent to and above a forward upper edge of the toilet tank when the device is in normal use position, and the second end of the piston rod further extending beyond the tank sufficiently far to be capable of contacting a cover of the bowl of the toilet in which toilet the device is installed when the cover of the toilet bowl is in an open, upright position and to be further capable of extending forwardly sufficiently far on a forward stroke actuated by flushing of the toilet to cause the toilet bowl cover to be pushed far enough past a vertical plane to fall forwardly to a downward, closed position, and a piston head on the rearwardly directed first end of the piston rod, the piston head being sized and shaped so as to be slidable within the housing and to form a watertight seal within an internal wall of the housing, so that the piston rod is caused to move linearly forwardly within the housing when water from the toilet tank water inlet source enters the inlet port and applies pressure against the piston head, thereby causing the piston rod second end to contact the cover of the toilet bowl and push the cover of the toilet bowl sufficiently far forwardly past a vertical plane so that gravity causes the cover to fall forwardly and downwardly to a substantially horizontal, closed position.

2. The device of claim 1, wherein the housing is elongated.

3. The device of claim 1, wherein the housing has an annular inner side wall.

4. The device of claim 3, wherein the piston head has an annular outer perimeter and the device further comprises an O-ring disposed transversely around the piston head to thereby cause the piston head to form a substantially watertight seal with the annular inner side wall of the housing.

5. The device of claim 1, and further comprising a spring within the housing, between the piston head and the second end of the housing, to bias the piston head linearly rearwardly and thereby cause the piston rod to retract into the housing when pressure from the water inlet source ceases.

6. The device of claim 1, wherein the water outlet port is formed in the housing at a position between the center of a longitudinal axis of the device and the second end of the device.

7. The device of claim 1, and further comprising a sleeve disposed around the piston rod, forwardly of the second end of the housing, the sleeve being sized in diameter sufficiently larger in relation to the piston rod to permit the piston rod to stroke easily forwardly and rearwardly within the sleeve without binding.

8. The device of claim 8, wherein the sleeve is formed of material of sufficient firmness and strength to support in part the weight of the lid of the toilet water tank.

9. The device of claim 1, wherein the structure for supporting the device in a substantially horizontal position is a bracket having a hook portion and a flange portion, the flange portion being connected to the second end of the housing and the hook portion extending forwardly of the second end of the housing, the hook portion being suitably sized and shaped for positioning over the upper edge of a front wall of the water tank, to thereby suspend the device in a substantially horizontal position inside of the top of the water tank, longitudinally with respect to the front and the back of the toilet in which the device is installed, and above the level of the water in the tank.

10. The device of claim 1, wherein the device is formed substantially entirely of a single piece of injection molded plastic.

11. The device of claim 1, and further comprising a hard sleeve disposed forwardly of the second end of the housing and around the second end of the piston rod, so as to provide a passage through the sleeve for the piston rod during each stroke thereof and to further provide structure for supporting the toilet tank lid which structure for supporting the toilet tank lid simultaneously protects the piston rod from contact with the toilet tank lid and further provides a site at which the weight of the toilet tank lid can facilitate holding the device in a preselected position substantially horizontally and longitudinally within the toilet tank, adjacent to the top of the tank.

12. The combination of a toilet and automatic toilet cover closing device wherein the toilet comprises a bowl having a seat selectively disposed above the bowl and a cover selectively disposed above the seat, and a water tank disposed above and behind the bowl, the seat and the cover being pivotally connected to the toilet rearwardly of the bowl and forwardly of the tank at a lower end of the tank, and further wherein the closing device comprises a housing having a first end and a second end and a continuous side wall extending between the first end and the second end, the continuous side wall of the housing defining a water outlet port formed through the continuous side wall, the housing first end having a water inlet port connectable to a source of water, the housing second end having a central aperture which is sized and positioned for passage therethrough of a piston rod, and the housing second end further having structure for supporting the device in a substantially horizontal position within a water tank of the toilet in which the device is installed, the normal use position of the device in the water tank being above the level of water, with the housing first end being directed toward the rear of the tank and connected to a toilet water tank water inlet source when the device is installed in a toilet in normal use position, and with the housing second end being supported on the front of the toilet water tank by the structure for supporting the device in a substantially horizontal position, and a piston having a piston rod disposed longitudinally within the housing, the piston rod having a first end and a second end, the piston rod first end extending rearwardly in the housing, and the second end of the piston rod extending forwardly through the aperture in the second end of the housing, adjacent to and above a forward upper edge of the toilet tank when the device is in normal use position, and the second end of the piston rod further extending beyond the tank sufficiently far to be capable of contacting a cover of the bowl of the toilet in which toilet the device is installed when the cover of the toilet bowl is in an open, upright position and to be further capable of extending forwardly sufficiently far on a forward stroke actuated by flushing of the toilet to cause the toilet bowl cover to be pushed far enough past a vertical plane to fall forwardly to a downward, closed position, and a piston head on the rearwardly directed first end of the piston rod, the piston head being sized and shaped so as to be slidable within the housing and to form a watertight seal within an internal wall of the housing, so that the piston rod is caused to move linearly forwardly within the housing when water from the toilet tank water inlet source enters the inlet port and applies pressure against the piston head, thereby causing the piston rod second end to contact the cover of the toilet bowl and push the cover of the toilet bowl sufficiently far forwardly past a vertical plane so that gravity causes the cover to fall forwardly and downwardly to a substantially horizontal, closed position.

13. A kit for installation into a toilet of a device for automatically closing a toilet cover upon flushing of the toilet by a user of the toilet, the kit comprising a linear valve device, and a plurality of pieces of tubing of various lengths and diameters, so that the user can select from the plurality of pieces of tubing any of the pieces which is appropriate for the specific type of toilet into which the device is to be installed, and further wherein the linear valve device comprises a housing having a first end and a second end and a continuous side wall extending between the first end and the second end, the continuous side wall of the housing defining a water outlet port formed through the continuous side wall, the housing first end having a water inlet port connectable to a source of water, the housing second end having a central aperture which is sized and positioned for passage therethrough of a piston rod, and the housing second end further having structure for supporting the device in a substantially horizontal position within a water tank of the toilet in which the device is installed, the normal use position of the device in the water tank being above the level of the water, with the housing first end being directed toward the rear of the tank and connected to a toilet water tank water inlet source when the device is installed in a toilet in normal use position, and with the housing second end being supported on the front of the toilet water tank by the structure for supporting the device in a substantially horizontal position, and a piston having a rigid rod and a head fixed on one end of the piston rod, the piston rod being disposed longitudinally within the housing and having a first end and a second end, the piston rod first end extending rearwardly in the housing, and the second end of the piston rod extending forwardly through the aperture in the second end of the housing, adjacent to and above a forward upper edge of the toilet tank when the device is in normal use position, and the second end of the piston rod further extending beyond the tank sufficiently far to be capable of contacting a cover of the bowl of the toilet in which toilet the device is installed when the cover of the toilet bowl is in an open, upright position and to be further capable of extending forwardly sufficiently far on a forward stroke actuated by flushing of the toilet to cause the toilet bowl cover to be pushed far enough past a vertical plane to be caused by gravity to fall forwardly to a downward, closed position, and a piston head on the rearwardly directed first end of the piston rod, the piston head being sized and shaped so as to be slidable within the housing and to form a watertight seal within an internal wall of the housing, so that the piston rod is caused to move linearly forwardly within the housing when water from the toilet tank water inlet source enters the inlet port and applies pressure against the piston head, thereby causing the piston rod second end to contact the cover of the toilet bowl and push the cover of the toilet bowl sufficiently far forwardly past a vertical plane so that gravity causes the cover to fall forwardly and downwardly to a substantially horizontal, closed position.

14. The kit of claim 13, and further comprising at least one pad adapted for attachment to an underside of the toilet seat and the toilet bowl cover, to thereby dampen noise and shock to the toilet bowl rim when the toilet bowl cover and toilet seat are caused by the closing device to pivot forwardly and fall to the closed position.

15. The kit of claim 14, wherein the at least one pad is adapted for attachment to the underside of the toilet seat and the toilet bowl cover by having adhesive so that the at least one pad can be selectively applied at a preselected position to the underside of the toilet seat and the toilet bowl cover.

* * * * *